US008246050B2

(12) United States Patent
Do et al.

(10) Patent No.: US 8,246,050 B2
(45) Date of Patent: Aug. 21, 2012

(54) INTELLIGENT SYSTEM TO INDICATE APPROPRIATE TRAJECTORIES IN CUE SPORTS

(75) Inventors: Lydia Mai Do, RTP, NC (US); Pamela Ann Nesbitt, Ridgefield, CT (US)

(73) Assignee: International Business Machines Corporation, Armonk, NY (US)

( * ) Notice: Subject to any disclaimer, the term of this patent is extended or adjusted under 35 U.S.C. 154(b) by 801 days.

(21) Appl. No.: 12/352,672

(22) Filed: Jan. 13, 2009

(65) Prior Publication Data

US 2010/0178994 A1 Jul. 15, 2010

(51) Int. Cl.
*A63D 15/00* (2006.01)

(52) U.S. Cl. ..... 273/317; 273/317.1; 473/1; 473/2; 473/4; 473/9; 473/24; 473/27; 473/29

(58) Field of Classification Search ..... 473/1, 2, 473/4, 9, 24, 27, 29; 273/317, 317.1
See application file for complete search history.

(56) References Cited

U.S. PATENT DOCUMENTS

| | | | | |
|---|---|---|---|---|
| 3,463,593 | A * | 8/1969 | Horan | 473/2 |
| 3,466,038 | A * | 9/1969 | Hill | 473/4 |
| 4,183,523 | A * | 1/1980 | Hecht | 473/40 |
| 4,688,796 | A * | 8/1987 | Wright | 473/2 |
| 4,882,676 | A | 11/1989 | Van De Kop et al. | 473/2 |
| 5,026,053 | A * | 6/1991 | Paterson et al. | 473/23 |
| 5,066,008 | A * | 11/1991 | Rivera | 473/23 |
| 5,342,041 | A * | 8/1994 | Agulnek et al. | 473/2 |
| 5,365,427 | A * | 11/1994 | Soignet et al. | 473/448 |
| 5,738,591 | A | 4/1998 | Opsal | 473/4 |
| 6,267,686 | B1 | 7/2001 | Legacie, Jr. | 473/44 |
| 6,761,643 | B2 * | 7/2004 | Boatwright | 473/2 |
| 6,769,992 | B1 | 8/2004 | Domulevicz et al. | 473/2 |
| 6,875,120 | B1 * | 4/2005 | Ellis | 473/2 |
| 6,942,577 | B2 | 9/2005 | McKevitt et al. | 473/44 |
| 7,063,620 | B2 * | 6/2006 | Nearhood | 473/2 |
| 7,118,486 | B2 * | 10/2006 | Evers | 473/2 |
| 7,165,332 | B2 * | 1/2007 | McGrail et al. | 33/286 |
| 7,247,101 | B2 | 7/2007 | Maurer | 473/17 |

(Continued)

FOREIGN PATENT DOCUMENTS

EP 536810 A1 * 4/1993

(Continued)

OTHER PUBLICATIONS

"PickPocket: A Computer Billiards Shark" written by Michael Smith, published by Science Direct, available on or before Apr. 29, 2007, Artificial Intelligence 171, pp. 1069-1091.*

(Continued)

*Primary Examiner* — Dmitry Suhol
*Assistant Examiner* — Jason Skaarup
(74) *Attorney, Agent, or Firm* — VanLeeuwen & VanLeeuwen; Jeffrey S. LaBaw

(57) ABSTRACT

A game manager receives a request from a user to play a cue sport, which includes a table and a plurality of balls. The game manager retrieves user attributes corresponding to the user that include a user skill level. Next, the game manager detects ball locations for each of the plurality of balls, and determines one or more beginning shot opportunities based upon the user skill level and the plurality of ball locations. In turn, the game manager provides the beginning shot opportunities to the user.

14 Claims, 15 Drawing Sheets

U.S. PATENT DOCUMENTS

| | | | | |
|---|---|---|---|---|
| 7,384,341 | B2 * | 6/2008 | Martin et al. | 473/27 |
| 2003/0059752 | A1 * | 3/2003 | Gratkowski et al. | 434/247 |
| 2003/0216188 | A1 | 11/2003 | Boatwright | 473/2 |
| 2004/0224780 | A1 * | 11/2004 | Nagle | 473/2 |
| 2005/0009613 | A1 | 1/2005 | Davis | 473/2 |
| 2005/0037851 | A1 | 2/2005 | Evers | 473/2 |
| 2005/0101395 | A1 | 5/2005 | Keating | 473/2 |
| 2005/0209013 | A1 | 9/2005 | Davis et al. | 473/2 |
| 2006/0166752 | A1 | 7/2006 | Black | 473/2 |
| 2007/0026956 | A1 * | 2/2007 | Pearson | 473/1 |
| 2008/0220887 | A1 * | 9/2008 | Evans et al. | 473/2 |
| 2008/0269925 | A1 * | 10/2008 | Lita | 700/92 |
| 2009/0054168 | A1 * | 2/2009 | Bilgen et al. | 473/1 |
| 2009/0286610 | A1 * | 11/2009 | Schofield, Sr. | 473/1 |
| 2009/0302533 | A1 * | 12/2009 | Smith | 273/108.1 |
| 2011/0070960 | A1 * | 3/2011 | Greenspan | 473/2 |

FOREIGN PATENT DOCUMENTS

| | | |
|---|---|---|
| EP | 1314464 | 5/2003 |

OTHER PUBLICATIONS

"Snooker Robot Player—20 Years On" written by Ho, et al., published by Computational Intelligence and Games, available on or before Jun. 4, 2007, pp. 1-8.*

"Grey decision-making for a billiard robot" written by Lin, et al., published by IEEE at International Conference on Man, Systems and Cybernetics, available on or before Mar. 7, 2005, vol. 6, pp. 5350-5355.*

"An Interactive and Immersive 3D Game Simulation Provided with Force Feedback" written by De Paolis, et al., published by IEEE at 2008 First International Conference on Advances in Computer-Human Interaction, available on or before Feb. 25, 2008, pp. 26-30.*

"A Vision Based Interactive Billiard Ball Entertainment System" written by Shih, et al., published by IEEE at DIGITEL 2007, available on or before Apr. 10, 2007, pp. 200-202.*

"Support System for pocket billiards" written by Takahashi, et al., published by IEEE at SICE Annual Conference 2008, available on or before Oct. 21, 2008, pp. 3233-3236.*

* cited by examiner

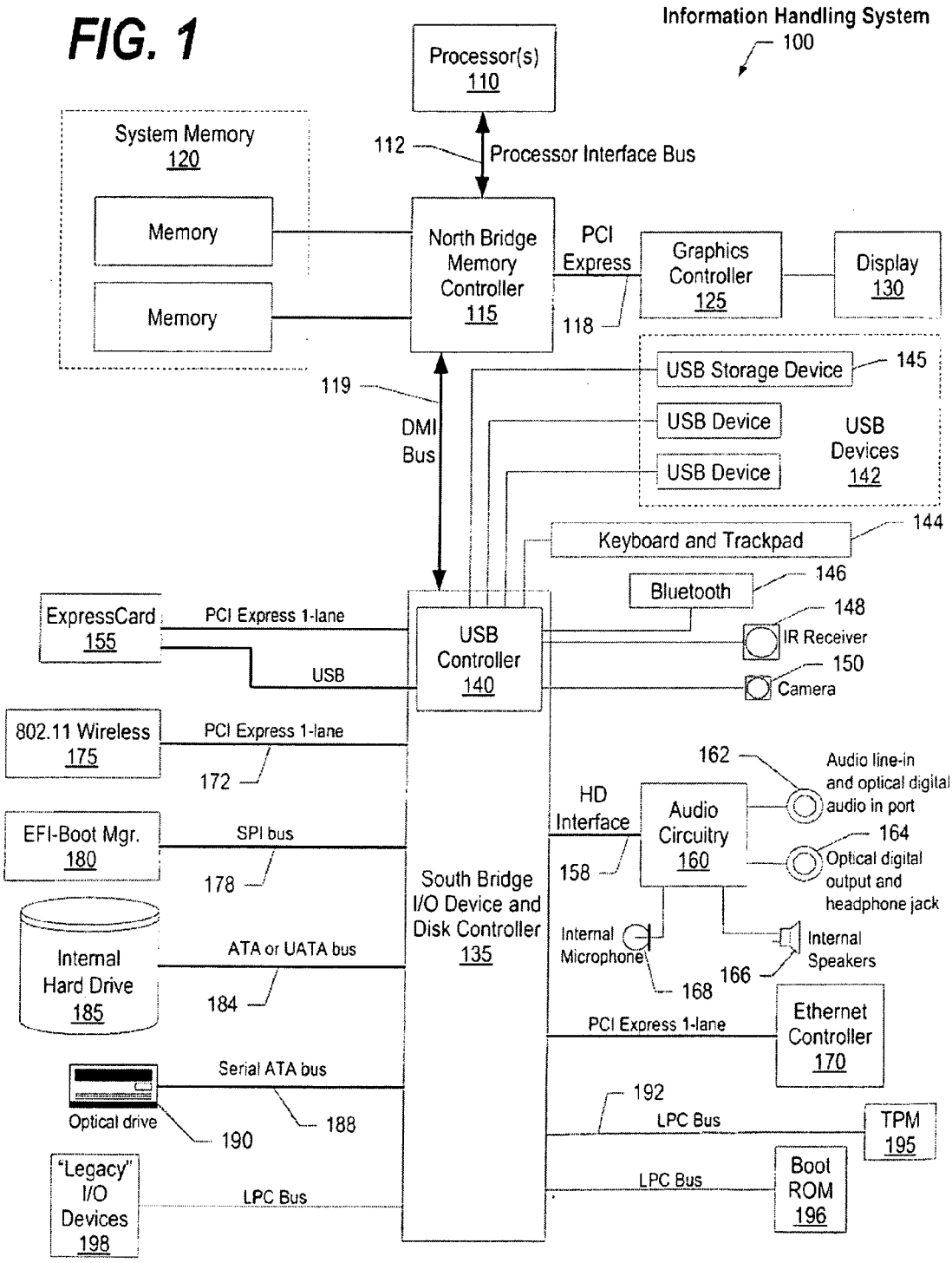
FIG. 1
Information Handling System
100
Processor(s)
110
112
Processor Interface Bus
System Memory
120
Memory
Memory
North Bridge
Memory
Controller
115
PCI
Express
118
Graphics
Controller
125
Display
130
119
DMI
Bus
USB Storage Device
145
USB Device
USB Device
USB
Devices
142
Keyboard and Trackpad
144
Bluetooth
146
148
IR Receiver
150
Camera
ExpressCard
155
PCI Express 1-lane
USB
USB
Controller
140
802.11 Wireless
175
PCI Express 1-lane
172
EFI-Boot Mgr.
180
SPI bus
178
Internal
Hard Drive
185
ATA or UATA bus
184
South Bridge
I/O Device and
Disk Controller
135
HD
Interface
158
Audio
Circuitry
160
162
Audio line-in
and optical digital
audio in port
164
Optical digital
output and
headphone jack
Internal
Microphone
168
Internal
Speakers
166
PCI Express 1-lane
Ethernet
Controller
170
Serial ATA bus
Optical drive
190
188
192
LPC Bus
TPM
195
"Legacy"
I/O
Devices
198
LPC Bus
LPC Bus
Boot
ROM
196

User Profile Table
940

| USER ID | NAME | HEIGHT | SKILL LEVEL | SHOT TYPE SUCCESS | RECENT STICK ID |
|---|---|---|---|---|---|
| 1234 | John Smith | 6'0" | 6 | 65% Bank, 85% Straight | DEF |
| 5471 | Beth Doe | 5'0" | 8 | 75% Bank, 90% Straight | FDS |
| ... | ... | ... | ... | ... | ... |

905 910 915 920 925 930

FIG. 9A

Smart Stick Attributes Table
940

| STICK ID | FRICTION LEVEL | STRAIGHTNESS LEVEL | TIP LEVEL |
|---|---|---|---|
| DEF | 8 | 5 | 6 |
| FDS | 4 | 8 | 9 |
| ... | ... | ... | ... |

945 950 955 960

FIG. 9B

Smart Table Attributes Table
970

| FLATNESS LEVEL | BALL REBOUND LEVEL |
|---|---|
| 8 | 7 |

975 980

FIG. 9C

INTELLIGENT SYSTEM TO INDICATE APPROPRIATE TRAJECTORIES IN CUE SPORTS

BACKGROUND OF THE INVENTION

1. Technical Field

The present invention relates to an intelligent system to indicate appropriate trajectories in cue sports. More particularly, the present invention relates to providing shot opportunities to a user playing a cue sport that includes beginning shot opportunities, subsequent shot opportunities, and preferred shot opportunities.

2. Description of the Related Art

Cue sports like pocket billiards or Snookers are favorite games and pastimes for many users. In addition to learning the rules of these games, two important skills that a user should learn are correctly planning and executing shots. When a user learns to correctly plan and execute shots, a user is able to position balls for subsequent (follow-up) shots, place balls in a defensive posture, and select shots that have a higher probability of success.

SUMMARY

A game manager receives a request from a user to play a cue sport, which includes a table and a plurality of balls. The game manager retrieves user attributes corresponding to the user that include a user skill level. Next, the game manager detects ball locations for each of the plurality of balls, and determines one or more beginning shot opportunities based upon the user skill level and the plurality of ball locations. In turn, the game manager provides the beginning shot opportunities to the user.

The foregoing is a summary and thus contains, by necessity, simplifications, generalizations, and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

The present invention may be better understood, and its numerous objects, features, and advantages made apparent to those skilled in the art by referencing the accompanying drawings, wherein:

FIG. 1 is a block diagram of a data processing system in which the methods described herein can be implemented;

FIG. 9A is a table showing user attributes for a cue sport;

FIG. 9B is a table showing smart stick attributes for a cue sport;

FIG. 9C is a table showing smart table attributes for a cue sport, such as billiards;

DETAILED DESCRIPTION

Certain specific details are set forth in the following description and figures to provide a thorough understanding of various embodiments of the invention. Certain well-known details often associated with computing and software technology are not set forth in the following disclosure, however, to avoid unnecessarily obscuring the various embodiments of the invention. Further, those of ordinary skill in the relevant art will understand that they can practice other embodiments of the invention without one or more of the details described below. Finally, while various methods are described with reference to steps and sequences in the following disclosure, the description as such is for providing a clear implementation of embodiments of the invention, and the steps and sequences of steps should not be taken as required to practice this invention. Instead, the following is intended to provide a detailed description of an example of the invention and should not be taken to be limiting of the invention itself. Rather, any number of variations may fall within the scope of the invention, which is defined by the claims that follow the description.

Figure 2:
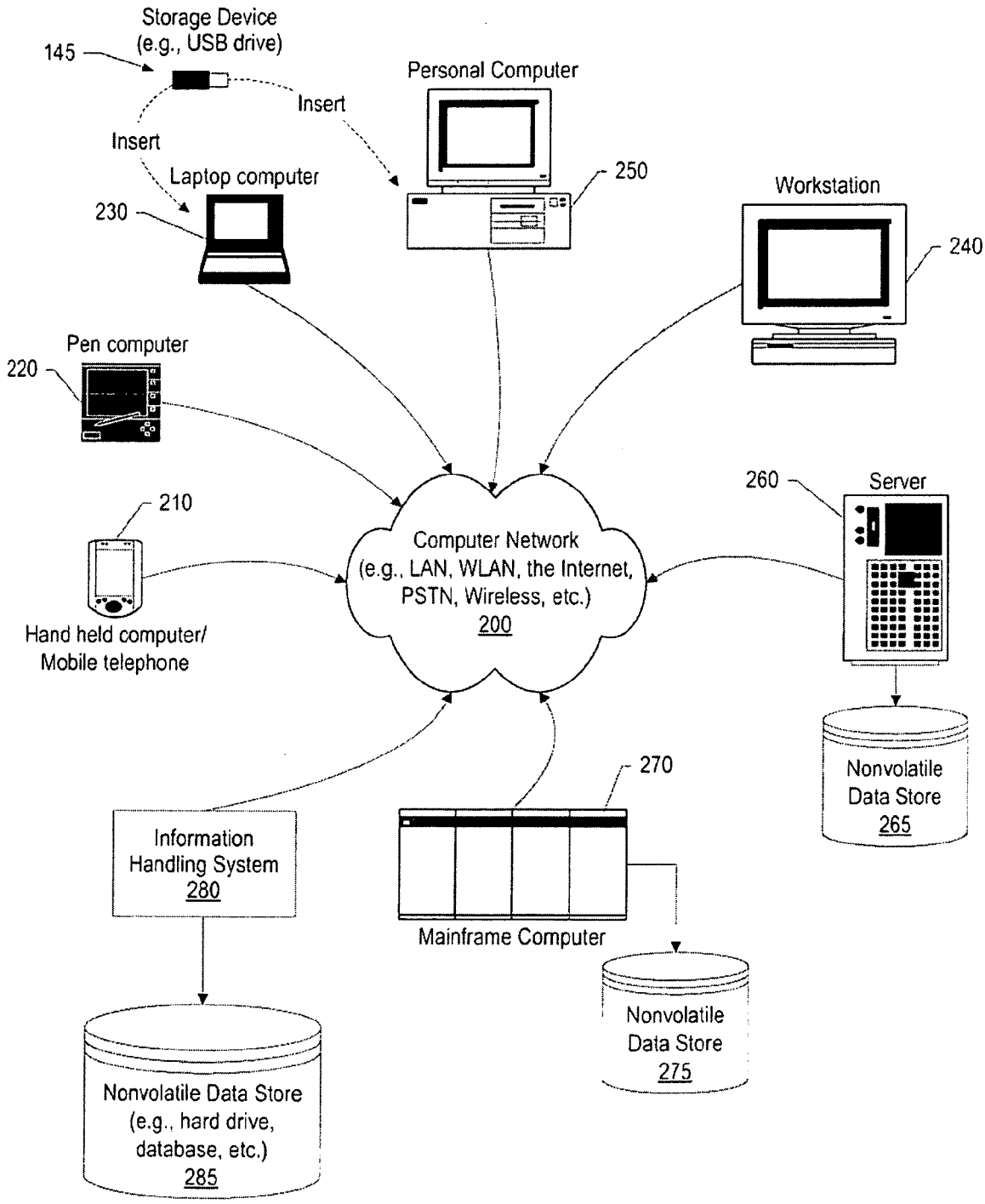
FIG. 2 provides an extension of the information handling system environment shown in FIG. 1 to illustrate that the methods described herein can be performed on a wide variety of information handling systems which operate in a networked environment.

The following detailed description will generally follow the summary of the invention, as set forth above, further explaining and expanding the definitions of the various aspects and embodiments of the invention as necessary. To this end, this detailed description first sets forth a computing environment in FIG. 1 that is suitable to implement the software and/or hardware techniques associated with the invention. A networked environment is illustrated in FIG. 2 as an extension of the basic computing environment, to emphasize that modern computing techniques can be performed across multiple discrete devices.

FIG. 1 illustrates information handling system 100, which is a simplified example of a computer system capable of performing the computing operations described herein. Information handling system 100 includes one or more processors 110 coupled to processor interface bus 112. Processor interface bus 112 connects processors 110 to Northbridge 115, which is also known as the Memory Controller Hub (MCH). Northbridge 115 connects to system memory 120 and provides a means for processor(s) 110 to access the system memory. Graphics controller 125 also connects to Northbridge 115. In one embodiment, PCI Express bus 118 connects Northbridge 115 to graphics controller 125. Graphics controller 125 connects to display device 130, such as a computer monitor.

Northbridge 115 and Southbridge 135 connect to each other using bus 119. In one embodiment, the bus is a Direct Media Interface (DMI) bus that transfers data at high speeds in each direction between Northbridge 115 and Southbridge 135. In another embodiment, a Peripheral Component Interconnect (PCI) bus connects the Northbridge and the Southbridge. Southbridge 135, also known as the I/O Controller Hub (ICH) is a chip that generally implements capabilities that operate at slower speeds than the capabilities provided by the Northbridge. Southbridge 135 typically provides various busses used to connect various components. These busses include, for example, PCI and PCI Express busses, an ISA bus, a System Management Bus (SMBus or SMB), and/or a Low Pin Count (LPC) bus. The LPC bus often connects low-bandwidth devices, such as boot ROM 196 and "legacy" I/O devices (using a "super I/O" chip). The "legacy" I/O devices (198) can include, for example, serial and parallel ports, keyboard, mouse, and/or a floppy disk controller. The LPC bus also connects Southbridge 135 to Trusted Platform Module (TPM) 195. Other components often included in Southbridge 135 include a Direct Memory Access (DMA) controller, a Programmable Interrupt Controller (PIC), and a storage device controller, which connects Southbridge 135 to nonvolatile storage device 185, such as a hard disk drive, using bus 184.

ExpressCard 155 is a slot that connects hot-pluggable devices to the information handling system. ExpressCard 155 supports both PCI Express and USB connectivity as it connects to Southbridge 135 using both the Universal Serial Bus (USB) the PCI Express bus. Southbridge 135 includes USB Controller 140 that provides USB connectivity to devices that connect to the USB. These devices include webcam (camera) 150, infrared (IR) receiver 148, keyboard and trackpad 144, and Bluetooth device 146, which provides for wireless personal area networks (PANs). USB Controller 140 also provides USB connectivity to other miscellaneous USB connected devices 142, such as a mouse, removable nonvolatile storage device 145, modems, network cards, ISDN connectors, fax, printers, USB hubs, and many other types of USB connected devices. While removable nonvolatile storage device 145 is shown as a USB-connected device, removable nonvolatile storage device 145 could be connected using a different interface, such as a Firewire interface, etcetera.

Wireless Local Area Network (LAN) device 175 connects to Southbridge 135 via the PCI or PCI Express bus 172. LAN device 175 typically implements one of the IEEE 802.11 standards of over-the-air modulation techniques that all use the same protocol to wireless communicate between information handling system 100 and another computer system or device. Optical storage device 190 connects to Southbridge 135 using Serial ATA (SATA) bus 188. Serial ATA adapters and devices communicate over a high-speed serial link. The Serial ATA bus also connects Southbridge 135 to other forms of storage devices, such as hard disk drives. Audio circuitry 160, such as a sound card, connects to Southbridge 135 via bus 158. Audio circuitry 160 also provides functionality such as audio line-in and optical digital audio in port 162, optical digital output and headphone jack 164, internal speakers 166, and internal microphone 168. Ethernet controller 170 connects to Southbridge 135 using a bus, such as the PCI or PCI Express bus. Ethernet controller 170 connects information handling system 100 to a computer network, such as a Local Area Network (LAN), the Internet, and other public and private computer networks.

While FIG. 1 shows one information handling system, an information handling system may take many forms. For example, an information handling system may take the form of a desktop, server, portable, laptop, notebook, or other form factor computer or data processing system. In addition, an information handling system may take other form factors such as a personal digital assistant (PDA), a gaming device, ATM machine, a portable telephone device, a communication device or other devices that include a processor and memory.

The Trusted Platform Module (TPM 195) shown in FIG. 1 and described herein to provide security functions is but one example of a hardware security module (HSM). Therefore, the TPM described and claimed herein includes any type of HSM including, but not limited to, hardware security devices that conform to the Trusted Computing Groups (TCG) standard, and entitled "Trusted Platform Module (TPM) Specification Version 1.2." The TPM is a hardware security subsystem that may be incorporated into any number of information handling systems, such as those outlined in FIG. 2.

FIG. 2 provides an extension of the information handling system environment shown in FIG. 1 to illustrate that the methods described herein can be performed on a wide variety of information handling systems that operate in a networked environment. Types of information handling systems range from small handheld devices, such as handheld computer/mobile telephone 210 to large mainframe systems, such as mainframe computer 270. Examples of handheld computer 210 include personal digital assistants (PDAs), personal entertainment devices, such as MP3 players, portable televisions, and compact disc players. Other examples of information handling systems include pen, or tablet, computer 220, laptop, or notebook, computer 230, workstation 240, personal computer system 250, and server 260. Other types of information handling systems that are not individually shown in FIG. 2 are represented by information handling system 280. As shown, the various information handling systems can be networked together using computer network 200. Types of computer network that can be used to interconnect the various information handling systems include Local Area Networks (LANs), Wireless Local Area Networks (WLANs), the Internet, the Public Switched Telephone Network (PSTN), other wireless networks, and any other network topology that can be used to interconnect the information handling systems. Many of the information handling systems include nonvolatile data stores, such as hard drives and/or nonvolatile memory. Some of the information handling systems shown in FIG. 2 depicts separate nonvolatile data stores (server 260 utilizes nonvolatile data store 265, mainframe computer 270 utilizes nonvolatile data store 275, and information handling system 280 utilizes nonvolatile data store 285). The nonvolatile data store can be a component that is external to the various information handling systems or can be internal to one of the information handling systems. In addition, removable nonvolatile storage device 145 can be shared among two or more information handling systems using various techniques, such as connecting the removable nonvolatile storage device 145 to a USB port or other connector of the information handling systems.

Figure 3:
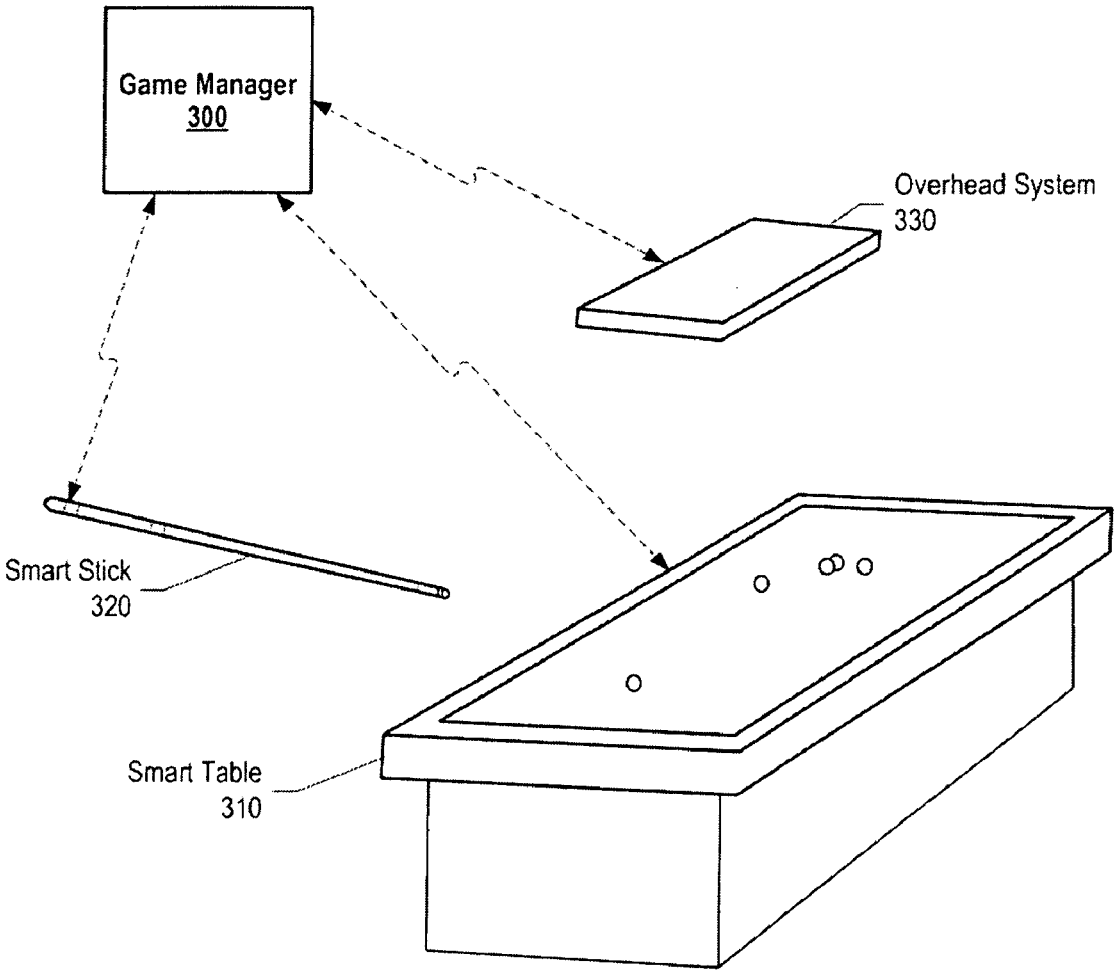
FIG. 3 is an exemplary diagram of a game system that indicates appropriate shot opportunity trajectories to a user during a cue sport.

FIG. 3 is an exemplary diagram of a game system that indicates appropriate shot opportunity trajectories to a user during a cue sport. Game manager 300 interacts with overhead system 300, smart stick 320, and smart table 310 to provide a simple learning system for beginner users as well as a comprehensive training system for experienced users. Game manager 300 uses geometry to compute and provide simple ball trajectories and shot opportunities. Game manager 300 also computes and provides more complicated actions such as "leaving" balls in particular locations for follow-up shots and contacting a cue ball at specific locations in order to invoke "English."

Smart table 310 is a cue sport table (e.g., billiards table) that may include sensors along its surface edges in order to detect ball locations. In one embodiment, smart table 310 may include touch-sensitive technology on its playing surface for detecting ball locations (see FIG. 4 and corresponding text for further details). In another embodiment, smart table 310 may include impact recognition technology in order to identify when a ball or hand contacts a pocket or side to indicate ball destination, and/or may also include gesture recognition technology to identify a user indicating a ball's travel and final pocket destination.

Smart stick 320 is a cue sport stick (e.g., pool cue) and may be configured to receive alignment guidance from game manager 300. For example, smart stick 320 may vibrate in order to inform a user that he/she is positioning smart stick 320 out of alignment, which increases in strength as smart stick 320's alignment differs from a preferred angle and decreases as the user positions smart stick 320 closer to proper alignment.

Game manager 300 interacts with overhead system 330 to display shot opportunities onto smart table 310. The shot opportunities may include various beginning shot opportunities, such as a straight shot to ball "6" or a bank shot to ball "12." In this example, overhead system 330 displays trajectory lines onto smart table 310 that show the beginning shot opportunities from a cue ball to balls 6 and 12. The displayed shot opportunities may also include subsequent (follow-up) shot opportunities as well as recommended shot opportunities (see FIGS. 5-7 and corresponding text for further details).

In one exemplary embodiment, a beginner user wishes to play a game and, in this embodiment, the player associates herself to smart stick 320, which is owned by an establishment. Smart stick 320 may be slightly bent, include an old tip, and is made of a wood that hasn't been sanded well, which results in poor sliding on the player's positioning hand. Game manager 300 may factor in smart stick 320's characteristics during shot opportunity computations.

In this embodiment, the user may register and enter attributes such as 1) height, which impacts the angle at which the user will hit a ball and also the difficulty in reaching distant balls; and 2) gender, which generally impacts the strength with which a ball is hit. After registration, game manager 300 logs the user's shot successes in order for game manager 300 to learn the user's shot preferences, shot strengths, and possibly modify game manager 300's profile for the type of user (e.g., females who are 4'10").

In this embodiment, overhead system 300 provides shot suggestions by highlighting them in colored lines between balls on smart table 310. As the user lines up for a shot and calls out an intended pocket, game manager 300 registers the command and informs smart stick 320 as to the proper angle. In turn, smart stick 320 vibrates more vigorously as the user is out of alignment and less vigorously as the user positions smart stick 320 into alignment. Smart stick 320 stops vibrating when the user correctly aligns smart stick 320 (see FIG. 8 and corresponding text for further details).

In another exemplary embodiment, an experienced user selects a registered stick or registers his personal stick. Since the user is more experienced, the user may request a higher level of interaction from game manager 300 that, in addition to suggesting beginning shot opportunities, also shows subsequent shot opportunities (follow-up shots) along with a recommended set of shot opportunities that has a highest probability of success.

In this embodiment, shot opportunities may be illuminated either on smart table 310 or on another nearby panel. Other options may include 1) indications on where to hit a cue ball and how hard to hit the cue ball so as to create the best "leave;" and 2) the best way to conduct a defensive play if the user is not able to pocket a ball but wishes to disarm his opponent.

As those skilled in the art can appreciate, the invention described herein may include a subset of items shown in FIG. 3. For example, smart table 310 may include a surface capable of projecting information (e.g., LCD) and, in this embodiment, overhead system 330 may not be required.

Figure 4:
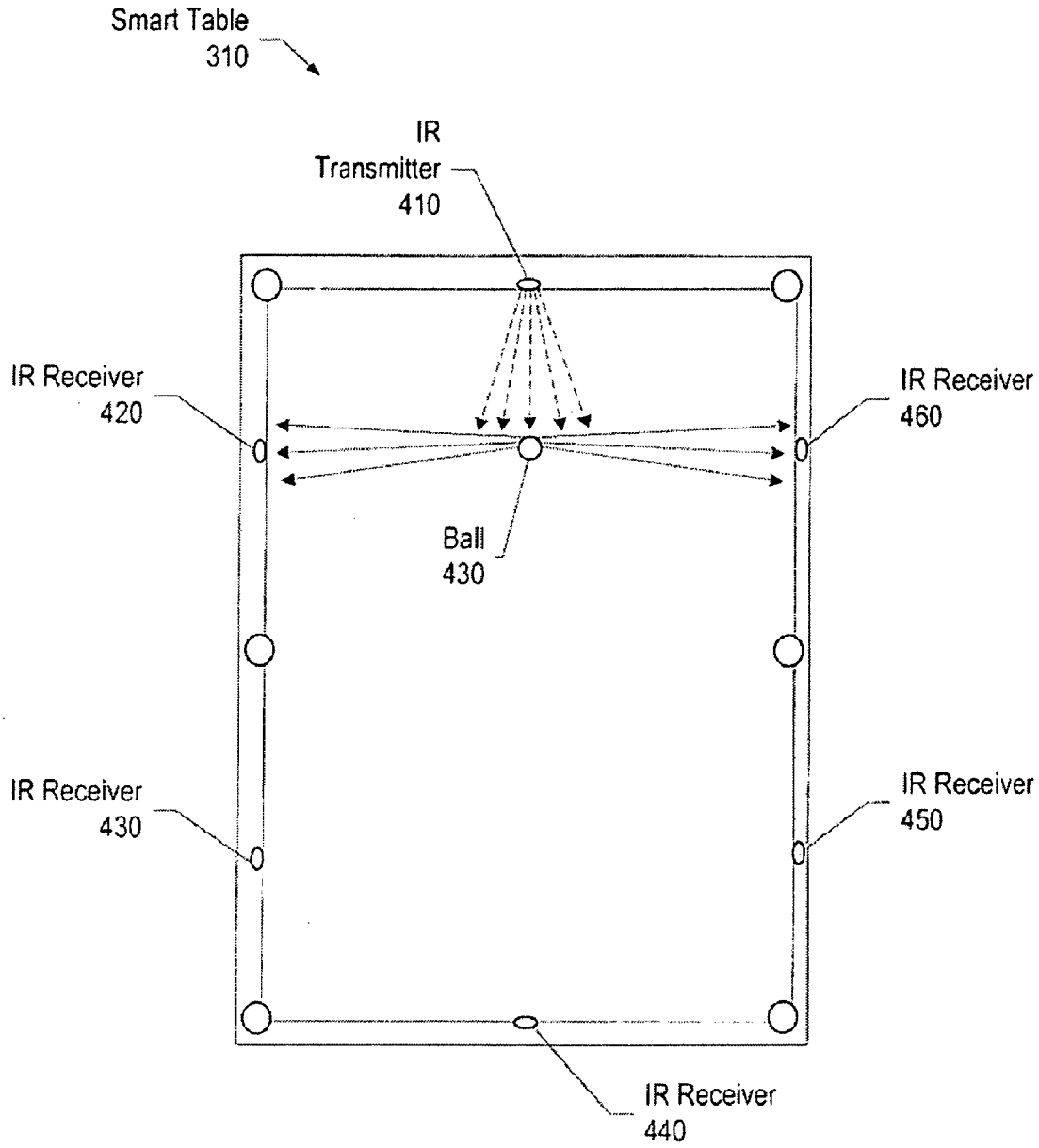
FIG. 4 is a diagram showing an exemplary embodiment of a smart table that detects ball locations.

FIG. 4 is a diagram showing an exemplary embodiment of a smart table that detects ball locations. Smart table 310 includes a mechanism to detect ball locations, which are subsequently utilized to identify and provide shot opportunities to a user. The example in FIG. 4 shows that smart table includes infrared (IR) transmitter 410, which transmits an infrared signal across smart table 310. When the infrared signal contacts ball 430, the infrared signal deflects and reaches one or more of infrared receivers 420 through 460. As one skilled in the art can appreciate, the location of ball 430 may be computed using the received infrared reflection properties.

In another embodiment, smart table 310 may include a touch sensitive top that identifies ball locations based upon detecting pressure at various spots on the touch sensitive top. In yet another embodiment, smart table 310 may include ball detection circuitry that interacts with "tags" embedded in ball 430. In this embodiment, each tag may identify ball 430's number (1, 2, 3, etc.) and whether ball 430 is a "solid" or a "stripe." In other embodiments, smart table 310 may utilize voice recognition technology to understand pocket calls and/or impact recognition technology to understand when a user depresses a pocket or side to indicate expected ball travel and final destination.

Figure 5:
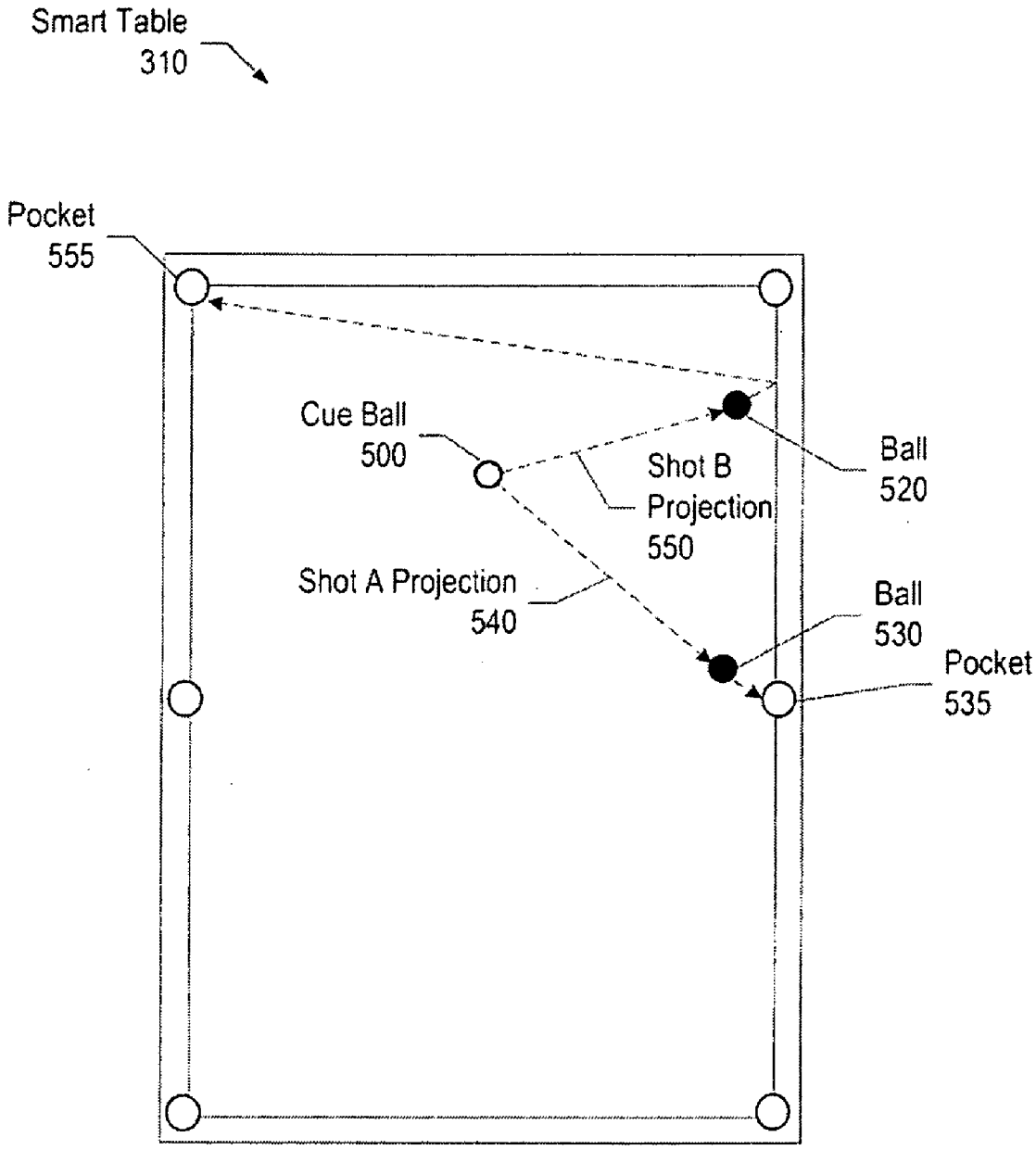
FIG. 5 is a diagram showing beginning shot opportunities on a smart table based upon ball locations on the smart table.

FIG. 5 is a diagram showing beginning shot opportunities on a smart table based upon ball locations on the smart table. Smart table 310 holds cue ball 500, ball 520, and ball 530. After detecting the locations of each ball, a game manager determines potential shot opportunities and displays the shot opportunities on smart table 310.

The example shows that two beginning shot opportunities exist, which correspond to shot A projection 540 and shot B projection 550. Shot A projection 540 is a straight shot from cue ball 500 to ball 530 into pocket 535, while shot B projection 550 is a bank shot starting at cue ball 500 to ball 520, which contacts a side bumper and banks into pocket 555. In one embodiment, the game manager utilizes historical shot accuracy to recommend a particular shot opportunity. For example, if a user historically makes bank shots more than straight shots, the game manager may highlight shot B projection 550 to inform the user to select the bank shot.

In one embodiment, shot opportunities are displayed using an overhead projector, such as overhead system 330 shown in FIG. 3. In another embodiment, smart table may be a display system (e.g., LCD) that is able to display the shot opportunities on the table surface.

Figure 6:
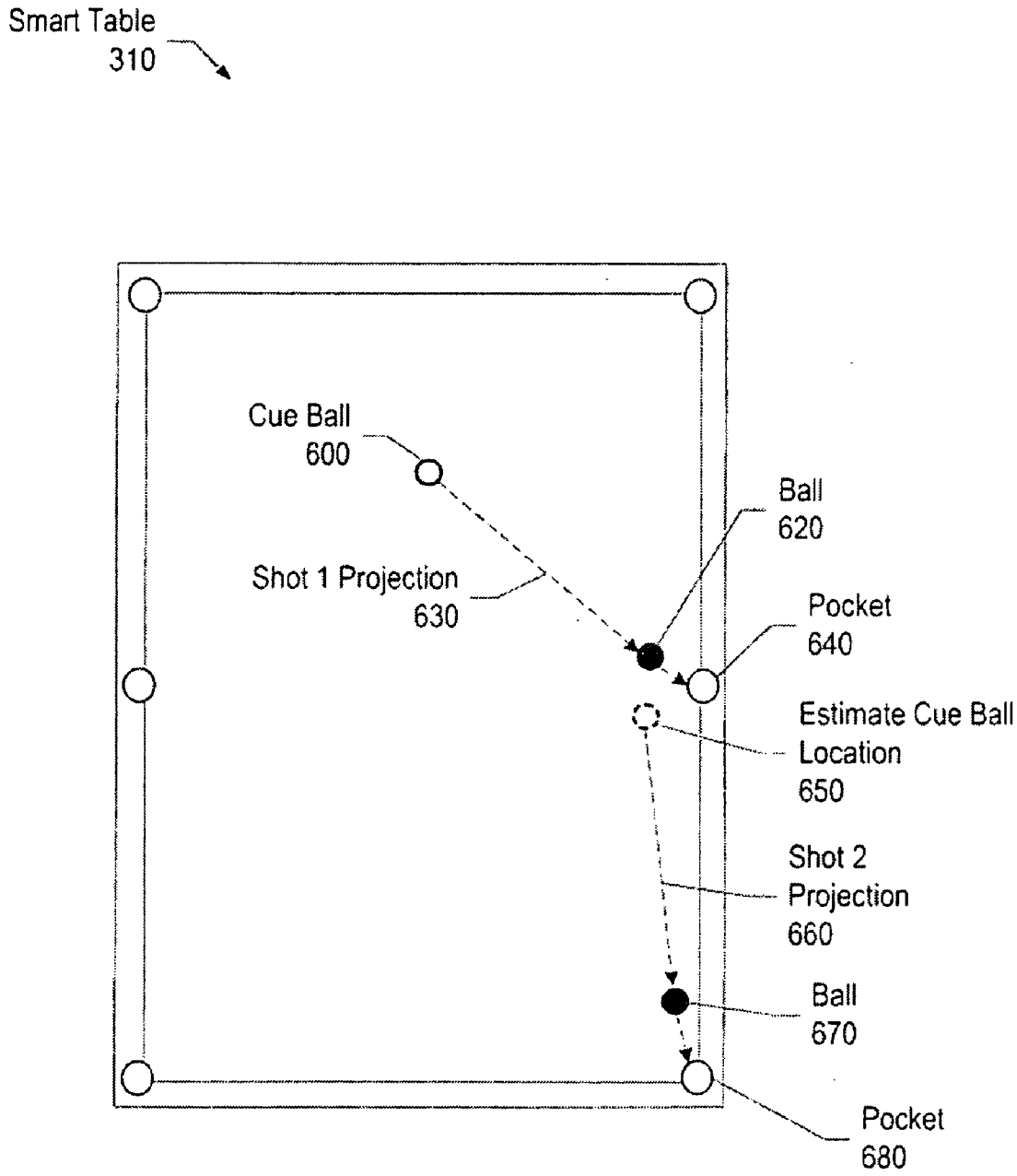
FIG. 6 is a diagram showing a beginning shot opportunity and a subsequent shot opportunity on a smart table based upon ball locations on the smart table.

FIG. 6 is a diagram showing a beginning shot opportunity and a subsequent shot opportunity on a smart table based upon ball locations on the smart table. Smart table 310 holds cue ball 600, ball 620, and ball 670. After detecting the locations of each ball, a game manager determines potential shot opportunities, which includes subsequent shot opportunities, and displays the shot opportunities on smart table 310.

Subsequent shot opportunities are estimated shot opportunities that will be available after a user conducts an earlier shot. For example, FIG. 6 shows shot 1 projection 630 is a beginning shot opportunity for placing ball 620 into pocket 640. A game manager estimates that cue ball 600 will be located at estimate cue ball location 650 after the user executes the beginning shot. Therefore, the game manager identifies a subsequent shot opportunity, which is shot 2 projection 660, for placing ball 670 into pocket 680.

By displaying both the beginning shot opportunity and the subsequent shot opportunity, the user is able to learn how to position cue ball 600 for follow-up shots.

Figure 7:
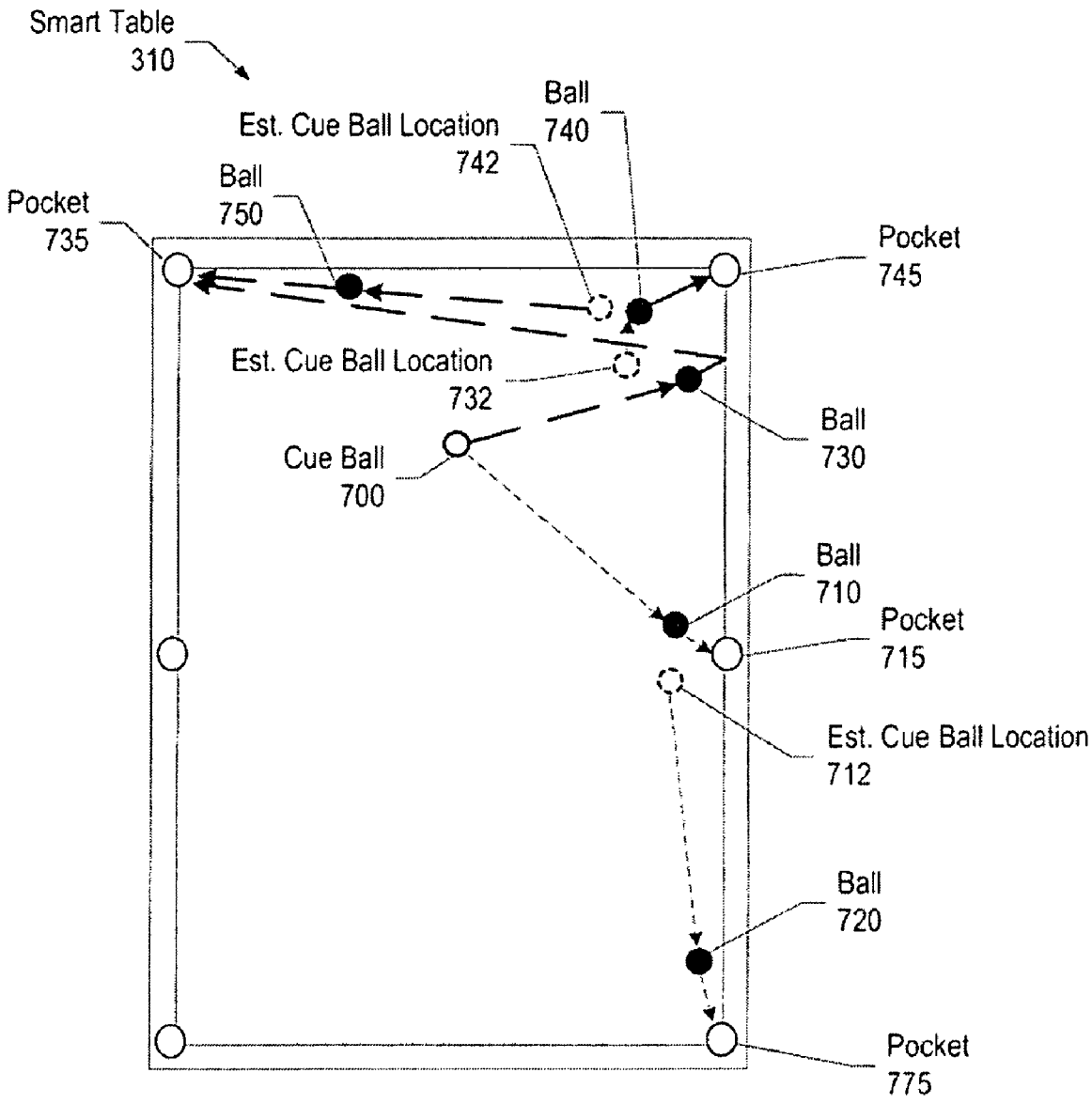
FIG. 7 is a diagram showing two sets of shot opportunities on a smart table based upon ball locations on the smart table.

FIG. 7 is a diagram showing two sets of shot opportunities on a smart table based upon ball locations on the smart table. A set of shot opportunities includes a beginning shot and one or more subsequent shot opportunities. Smart table 310 holds cue ball 700 and balls 710 through 750. After detecting the locations of each ball, a game manager determines potential beginning shot opportunities and corresponding subsequent shot opportunities.

In one embodiment, the game manager groups the shot opportunities into sets of shot opportunities. Each set of shot opportunities includes a beginning shot opportunity and subsequent shot opportunities. The example shown in FIG. 7 shows two sets of shot opportunities. The first set comprises cue ball 700, ball 710, and ball 720. The second set of shot opportunities includes cue ball 700, ball 730, ball 740, and ball 750. As can be seen, the first set of shot opportunities involves cue ball 700 placing ball 710 into pocket 715, which results in cue ball 700 finishing at estimate cue ball location 712. The next shot involves placing ball 720 into pocket 775. This first set of shot opportunities results in netting two balls in pockets.

Turning to the second set of shot opportunities, the second set of shot opportunities involves cue ball 700 placing ball 730 into pocket 735, which results in cue ball 700 finishing at estimate cue ball location 732. The next shot involves placing ball 740 into pocket 745, which results in cue ball 700 finishing at estimate cue ball location 742. The final shot involves placing ball 750 into pocket 735. As such, the second set of shot opportunities results in netting three balls in pockets. In one embodiment, the game manager may highlight a recommended set of shot opportunities based upon the number of potential net ball pockets. In another embodiment, the game manager may compute a "shot success probability" for each shot opportunity and recommend a particular set of shot opportunities based upon a cumulative shot success probability. For example, if a user historically makes straight shots and misses bank shots, the game manager may recommend a set of shot opportunities that include the most amount of straight shot opportunities see FIG. 15 and corresponding text for further details).

Figure 8:
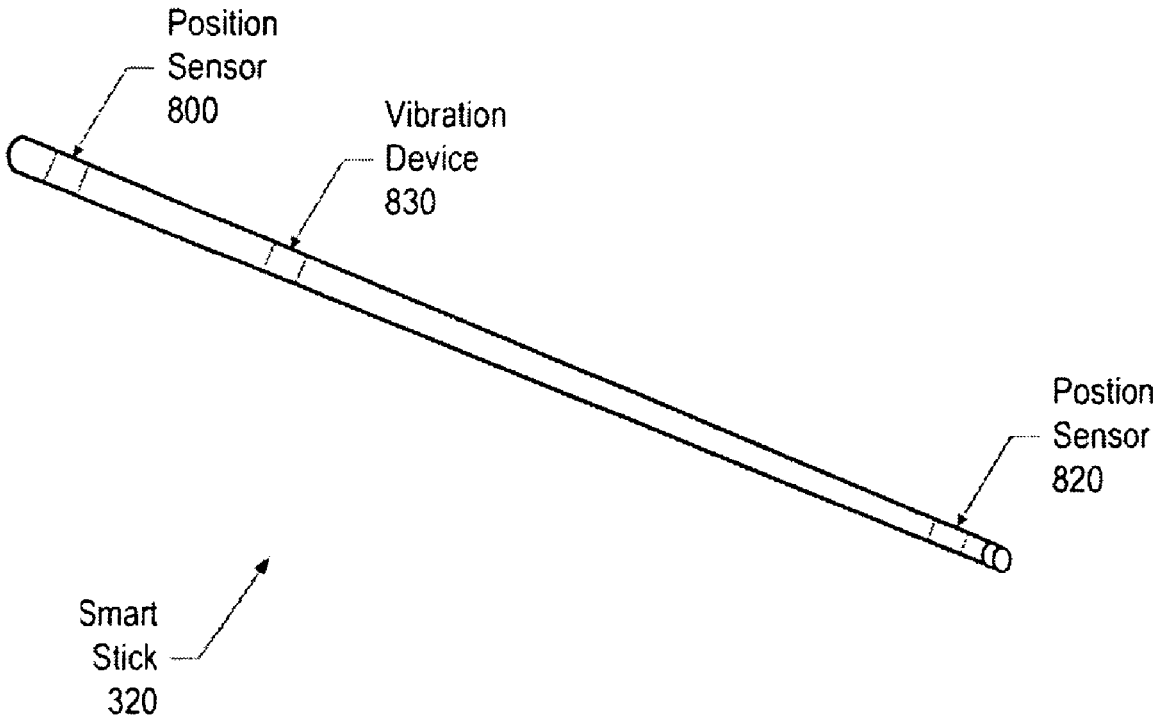
FIG. 8 is a diagram showing a smart stick that may be utilized with the invention described herein.

FIG. 8 is a diagram showing a smart stick that may be utilized with the invention described herein. Smart stick 320 is the same as that shown in FIG. 1, and includes position sensors 800-820 and vibration device 830. When a user is at a cue sport table and holding smart stick 320, a game manager is able to detect the relative position of smart stick 320 by detecting position sensor 800 and 820.

In turn, the game manager may send a signal to vibration device 830 to inform a user that smart stick 320 is out of alignment. For example, vibration device 830 may increase in strength as smart stick 320's position waivers from a preferred angle, and decreases as smart stick 320's alignment improves.

FIG. 9A is a table showing user attributes for a cue sport. Table 900 includes column 905, which lists user identifiers for particular users. A user registers with a game system and enters user attributes such as a name (column 910), user skill level (column 920), and/or physical attributes such as the user's height (column 915). A game system may utilize the physical attributes in order to determine shot opportunities. For example, a user's height contributes to an angle at which the user will contact a ball, and also contributes to the difficulty in reaching distant balls. In one embodiment, a user may register other physical attributes such as physical handicaps, user handedness (right/left handedness), and range of motion (e.g. wearing uncomfortable shoes, short skirt, tight jeans, etcetera).

The user registers a particular cue stick (column 930). In one embodiment, the stick belongs to an establishment. In another embodiment, the user owns the stick. In either case, the user (or equipment owner) may also enter equipment attributes such as stick attributes and table attributes that describe the condition of a smart stick and or table conditions (see FIGS. 9B, 9C, and corresponding text for further details). After registration, the game system logs the user's shots in order for the game system to compute a historical shot accuracy for various shot types (straight shots, bank shots, etc.) (column 925).

FIG. 9B is a table showing smart stick attributes for a cue sport. Table 940 includes a list of registered smart sticks that are utilized by users when playing a cue sport. Table 940 includes a list of stick identifiers (column 945) along with stick attributes shown in columns 950-960. For example, a stick may be slightly bent, has an old tip, and is made of a wood that hasn't been sanded well, which results in a high level of friction between the stick and the user's guide hand. A game manager may take these stick attributes into account due to the fact that they effect how the stick performs when it hits a ball.

FIG. 9C is a table showing smart table attributes for a cue sport, such as billiards. Table 970 includes a smart tables flatness level (column 975) and ball rebound level (column 980), which a game system may utilize in determining shot opportunities. For example, a smart table may have stiff bumpers (high rebound level) that cause a ball to rebound at a high rate of speed, thus effecting its final location. In this example, the game system may utilize this information in order to compute a cue ball's estimate location after a beginning shot opportunity (see FIG. 6 and corresponding text for further details).

In one embodiment, a game manager may utilize environmental attributes when identifying and computing shot opportunities such as 1) location surroundings (e.g., noise, temperature, humidity, etcetera); 2) atmospheric quality (e.g., smokiness in a bar setting, crowdedness of the room, etcetera); and 3) the user's emotional status (e.g., mood, stress level, etcetera). For example, a user may be heckled before the shot and sensors on the smart table or smart stick detect the user's increased heart rate, tension, and sweat level. In turn, the game manager is able determine the user's mood or interest in being able to execute a shot based upon a lower probability of success. In another example, the user may be annoyed because of x, y, z scenario within a temporal window of executing a shot, such as waiting for another person to move out of the user's way that is playing at an adjacent table.

Figure 10:
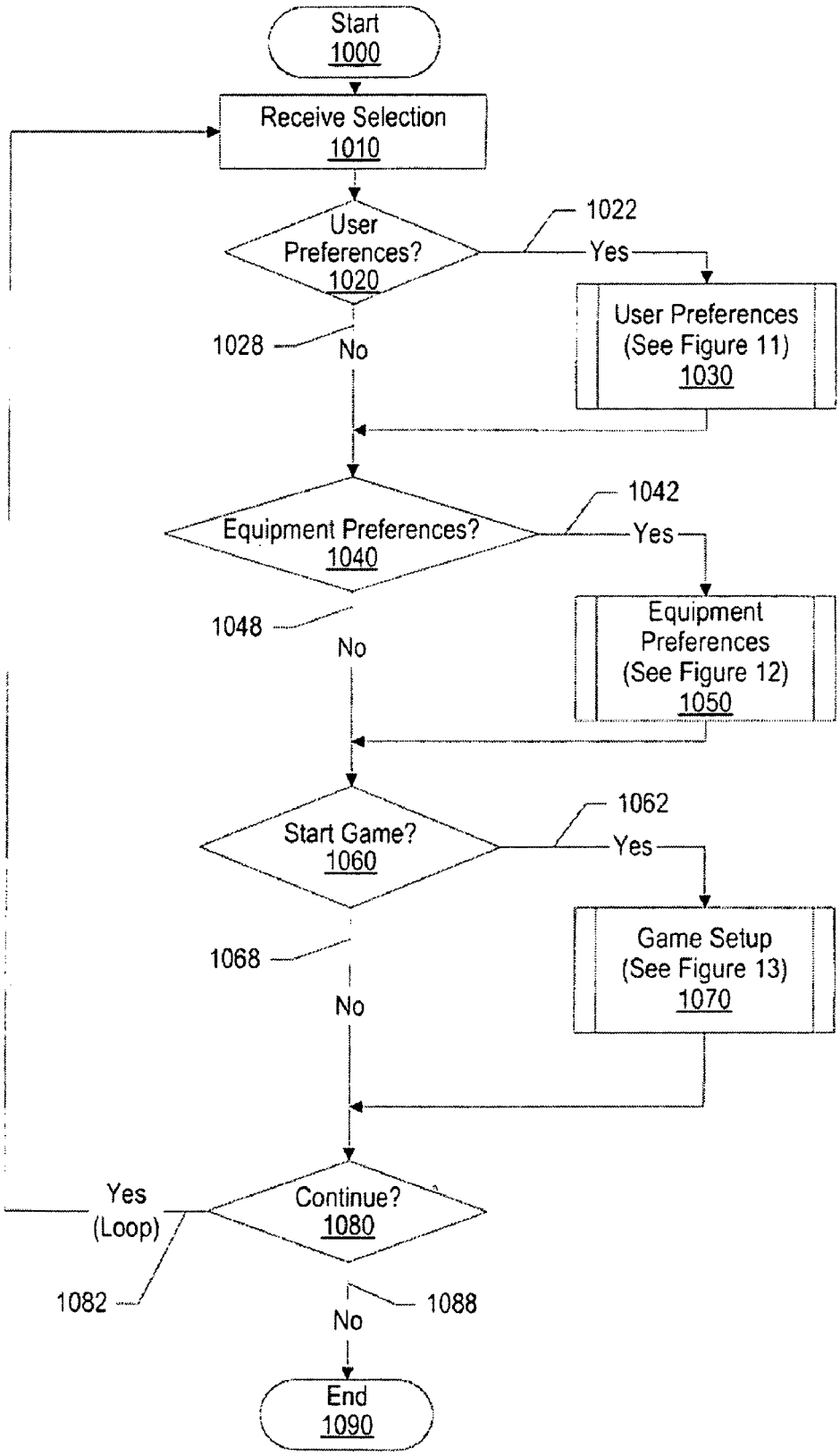
FIG. 10 is a high level flowchart showing steps taken in registering a user, registering cue sport equipment, and playing a cue sport.

FIG. 10 is a high level flowchart showing steps taken in registering a user, registering cue sport equipment, and playing a cue sport. Game system processing commences at 1000, whereupon the game system receives a selection at step 1010. For example, the game system may include a user interface window that allows a user to input user preferences, equipment preferences, or start a new game.

A determination is made as to whether the selection is a user preferences selection (decision 1020). If the selection is a user preferences selection, decision 1020 branches to "Yes" branch 1022 whereupon processing receives and stores user preferences (pre-defined process block 1030, see FIG. 11 and corresponding text for further details). On the other hand, if the selection is not a user preferences selection, decision 1020 branches to "No" branch 1028, bypassing user preference inputting steps.

A determination is made as to whether the selection is an equipment preferences selection, such as inputting smart stick attributes or smart table attributes (decision 1040). If the selection is an equipment preferences selection, decision 1040 branches to "Yes" branch 1042, whereupon processing receives and stores equipment preferences (pre-defined process block 1050, see FIG. 12 and corresponding text for further details). On the other hand, if the selection is not an equipment preferences selection, decision 1040 branches to "No" branch 1048, bypassing equipment preference inputting steps.

A determination is made as to whether the selection is to start a cue sport game (decision 1060). If the selection is to start a cue sport game, decision 1060 branches to "Yes" branch 1062 whereupon processing configures and starts a new cue sport game (pre-defined process block 1070, see FIG. 13 and corresponding text for further details). On the other hand, if the selection is not for starting a cue sport game, decision 1060 branches to "No" branch 1068, bypassing game configuration and playing steps.

A determination is made as to whether to continue receiving user selections (decision 1080). For example, a user may first select to register and then select to play a new game. If game system processing should continue, decision 1080 branches to "Yes" branch 1082, which loops back to receive and process another selection. This looping continues until game system processing should terminate, at which point decision 1080 branches to "No" branch 1088 whereupon processing ends at 1090.

Figure 11:
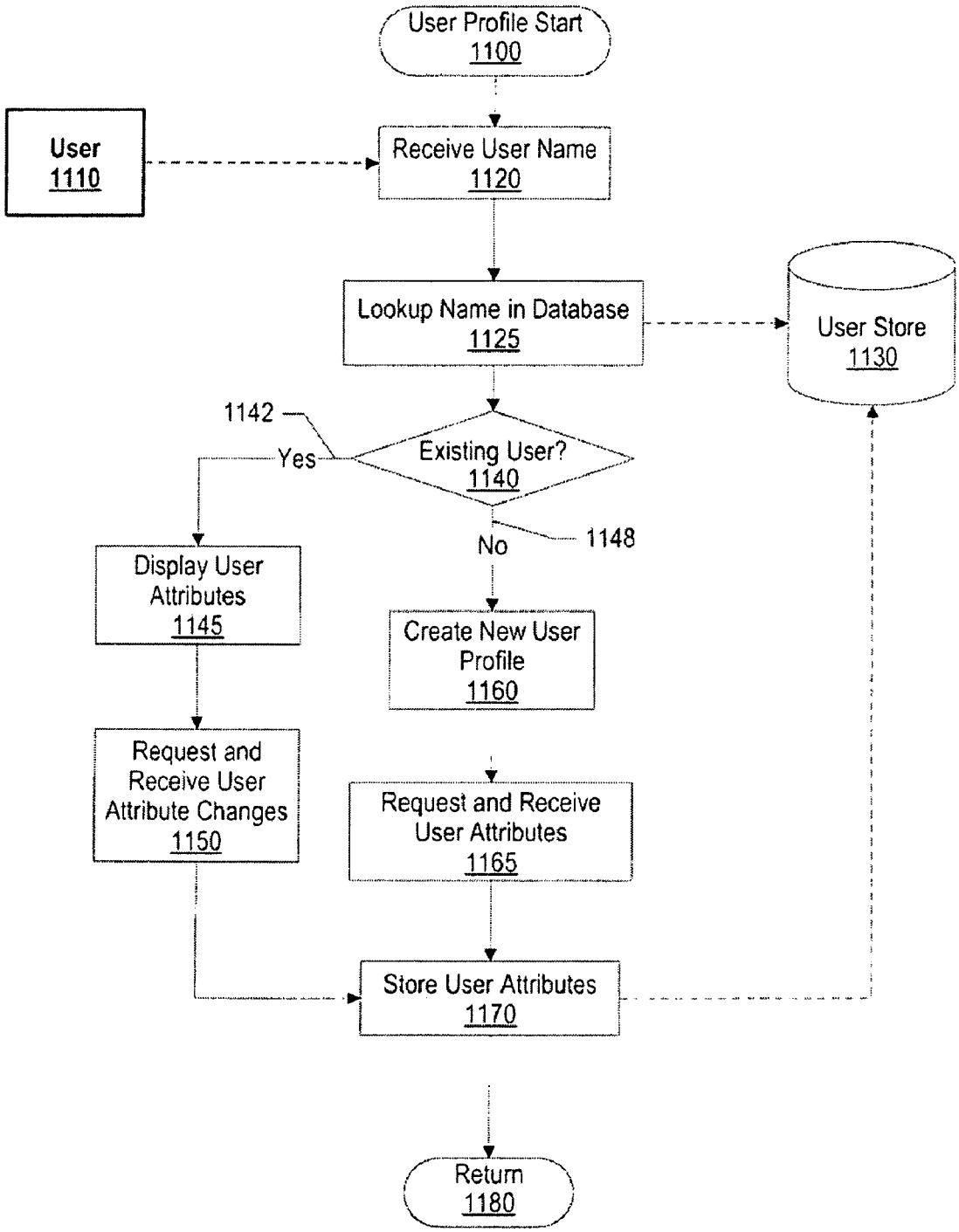
FIG. 11 is a flowchart showing steps taken in receiving and storing user attributes.

FIG. 11 is a flowchart showing steps taken in receiving and storing user attributes. User profile processing commences at 1100, whereupon processing receives a user name from user 1110 at step 1120. At step 1125, processing looks-up the user name in a user database located in user store 1130. For example, the user database may be a table that includes user names, user identifiers, and user attributes such as table 900 shown in FIG. 9A. User store 1130 may be stored on a nonvolatile storage area, such as a computer hard drive.

A determination is made as to whether the user name is included in the database (decision 1140). If the user name exists, decision 1140 branches to "Yes" branch 1142, whereupon processing displays the existing user attributes to user 1110 at step 1145. At step 1150, processing requests and receives user attribute changes from user 1110. For example, user 1110 may have bought a new smart stick and wish to associate the new smart stick with the user. Processing stores the received user attribute changes in user store 1130 at step 1170.

On the other hand, if the user name is not included in the database, decision 11140 branches to "No" branch 1148, whereupon processing creates a new user profile for the user at step 1160. Processing requests and receives user attributes from user 1110 at step 1165, which may include the user's height, a user skill level, and an associated smart stick identifier. Processing stores the received user attributes in user store 1130 at step 1170, and returns at 1180.

Figure 12:
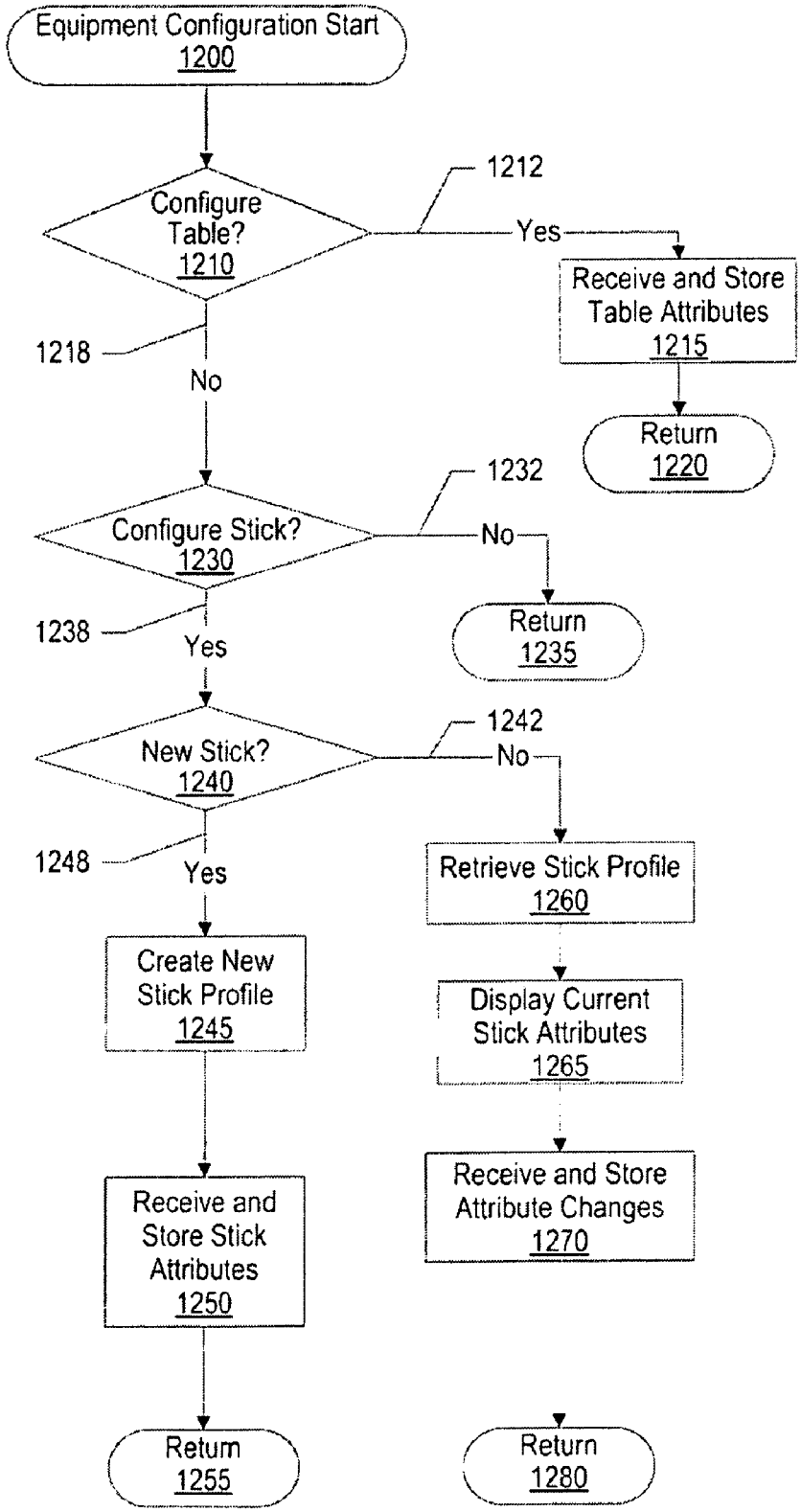
FIG. 12 is a flowchart showing steps taken in receiving cue sport equipment configuration information.

FIG. 12 is a flowchart showing steps taken in receiving cue sport equipment configuration information. Processing commences at 1200, whereupon a determination is made as to whether a user wishes to configure smart table attributes (decision 1210). For example, an establishment owner may have received a new billiards table and wish to input attributes as to the table's flatness and bumper rebound characteristics. If a user wishes to configure smart table attributes, decision 1210 branches to "Yes" branch 1212 whereupon processing receives and stores smart table attributes (step 1215), and returns at 1220.

On the other hand, if the user does not wish to input smart table attributes, decision 1210 branches to "No" branch 1218 whereupon a determination is made as to whether the user wishes to configure smart stick attributes (decision 1230). If the user does not wish to configure smart stick attributes, decision 1230 branches to "No" branch 1232 whereupon processing returns at 1235. On the other hand, if the user wishes to configure smart stick attributes, decision 1230 branches to "Yes" branch 1238.

A determination is made as to whether the user wishes to modify an existing smart stick profile or enter information for a new stick (decision 1240). For example, a user may install a new tip on an existing stick and wish to enter the new tip properties into an existing smart stick profile.

If the user wishes to modify an existing smart stick profile, decision 1240 branches to "No" branch 1042, whereupon processing retrieves the existing smart stick profile from a non-volatile storage area (step 1260). At step 1265, processing displays the current smart stick attributes to the user and, at step 1270, processing receives and stores the updated smart stick attributes (e.g., new tip properties). Processing returns at 1280.

On the other hand, if the user wishes to create a new smart stick profile, decision 1240 branches to "Yes" branch 1248 whereupon processing creates a new smart stick profile at step 1245. In one embodiment, processing may request the user to provide a smart stick user identifier, such as "Tom's stick" or "ABCD." Processing, at step 1250, receives and stores the smart stick attributes in a non-volatile storage area, and returns at 1255.

Figure 13:
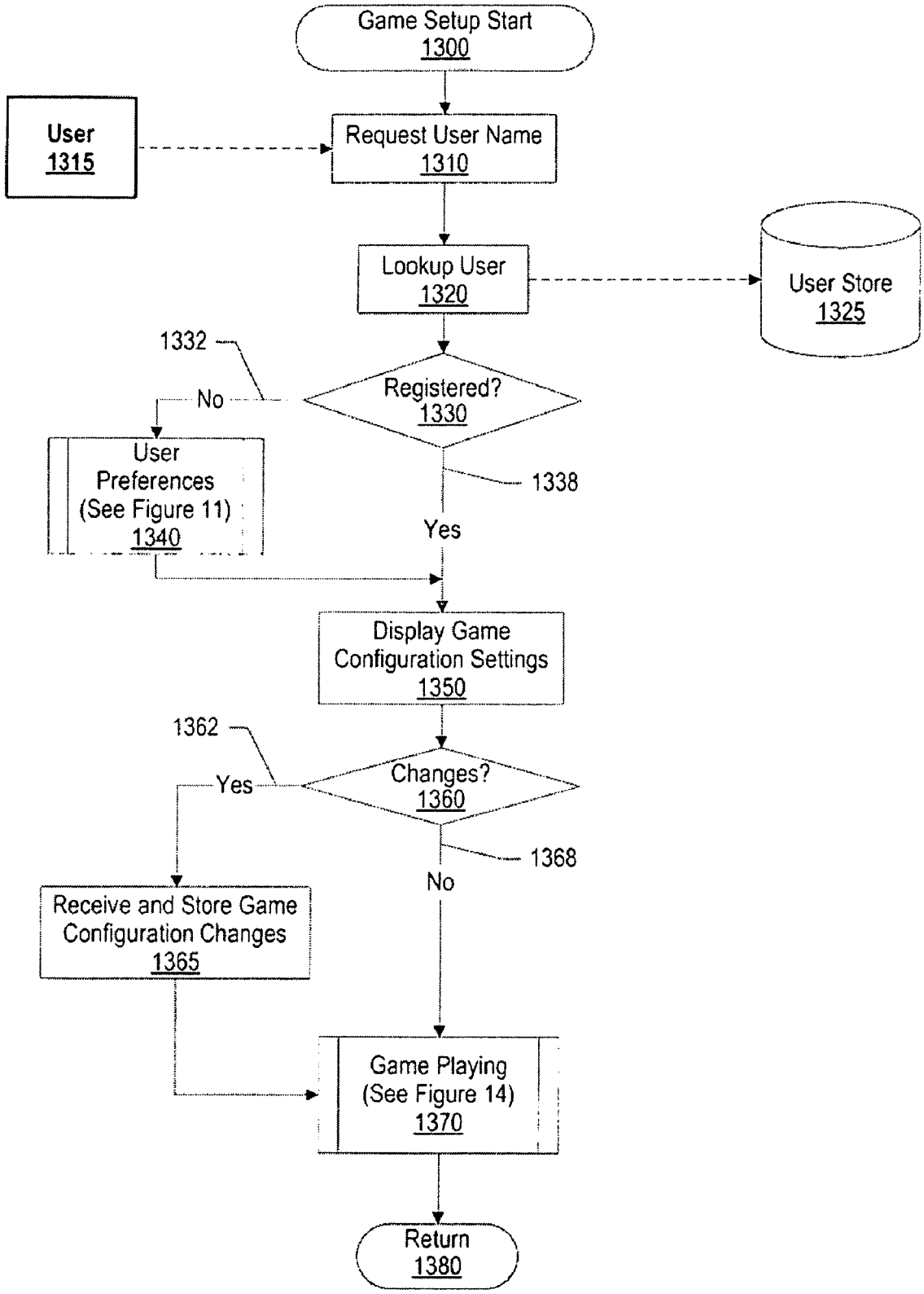
FIG. 13 is a flowchart showing steps taken in invoking a cue sport.

FIG. 13 is a flowchart showing steps taken in invoking a cue sport. Processing commences at 1300, whereupon processing requests user 1315's name at step 1310. At step 1320, processing looks up the user name in a database located in user store 1325 to identify whether the user is registered. User store 1325 may be stored on a nonvolatile storage area, such as a computer hard drive.

A determination is made as to whether user 1315 is registered (decision 1330). If user 1315 is not registered, decision 1330 branches to "No" branch 1332 whereupon processing proceeds through a series of steps to register the user (pre-defined process block 1340, see FIG. 11 and corresponding text for further details). On the other hand, if the user is already registered, decision 1330 branches to "Yes" branch 1338, bypassing user preferences configuration steps.

At step 1350, processing displays game configuration settings. For example, processing may display user names, corresponding smart sticks, and/or game system interaction preferences, such as default shot opportunity display preferences.

A determination is made as to whether user 1315 wishes to change the game configuration settings (decision 1360). For example, user 1315 may wish to add a user or configure the game system to display only beginning shot opportunities instead of all shot opportunities. If the user wishes to change the game configuration settings, decision 1360 branches to "Yes" branch 1362, whereupon processing receives and stores the new game configuration setting changes. On the other hand, if user 1315 does not wish to change the game configuration setting changes, decision 1360 branches to "No" branch 1368, bypassing step 1365.

At step 1370, processing provides user 1315 with shot opportunity information throughout the game and tracks user 1315's ball pocketing performance during the game, such as how well user 1315 executes straight shots and bank shots. Processing returns at 1380.

Figure 14:
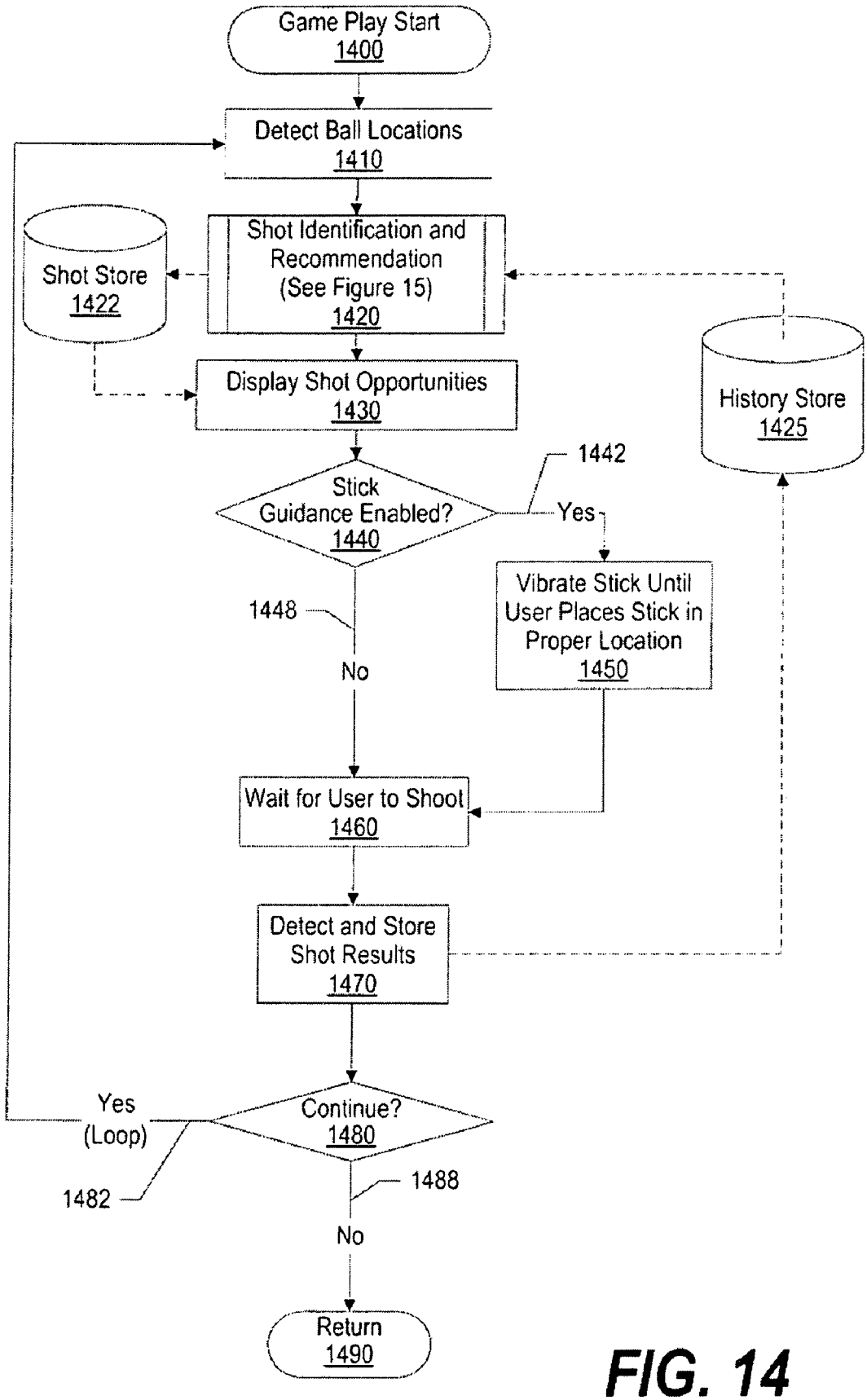
FIG. 14 is a flowchart showing steps taken in providing a user with shot opportunity information throughout a game and tracking the user's ball pocketing performance during the game.

FIG. 14 is a flowchart showing steps taken in providing a user with shot opportunity information throughout a game and tracking the user's ball pocketing performance during the game. As discussed in FIG. 4's description earlier, a smart table may include infrared transmitters/receivers, a touch sensitive top, and/or location circuitry embedded in the balls and table to detect ball locations.

Figure 15:
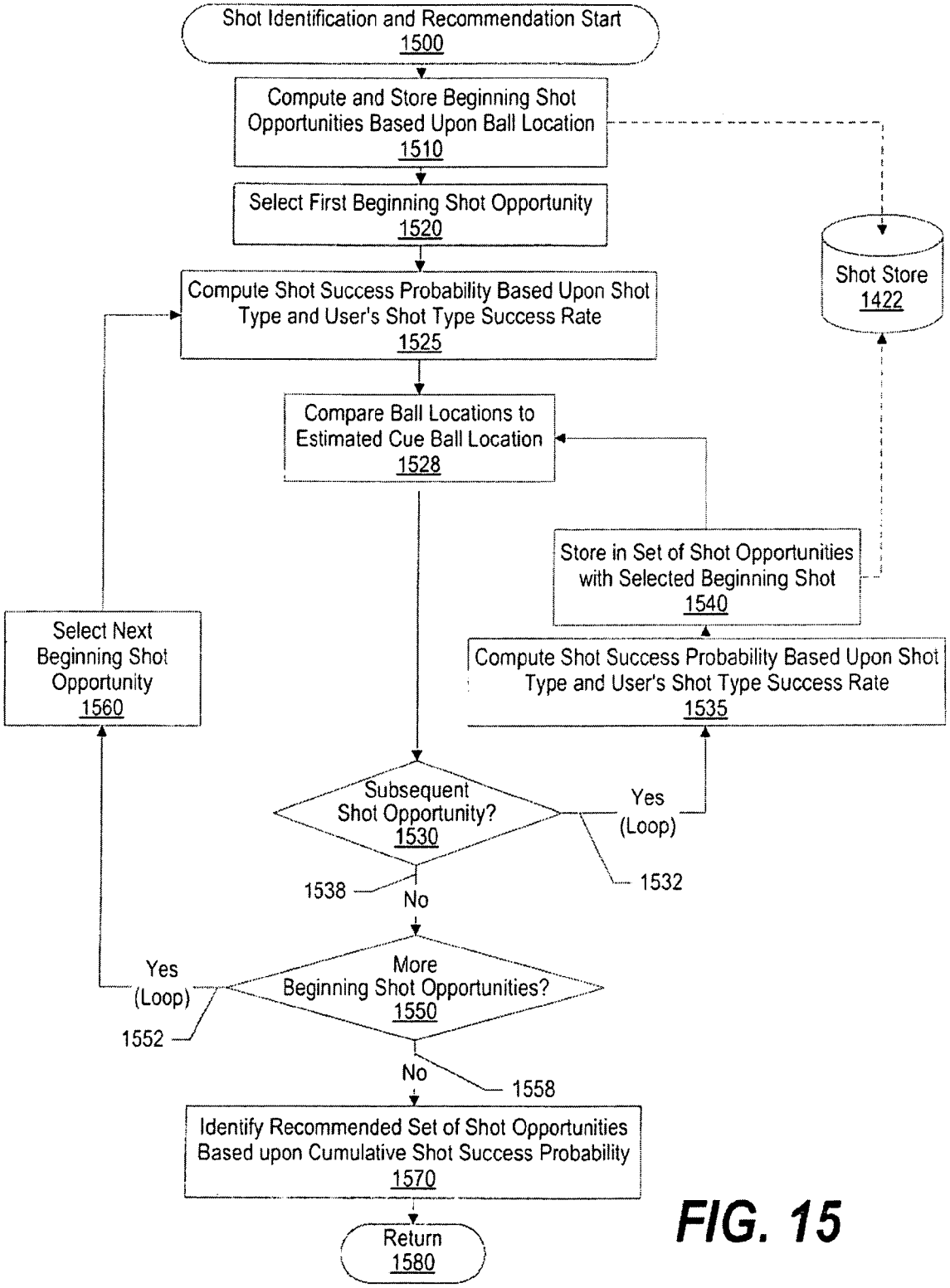
FIG. 15 is a flowchart showing steps taken in identifying shot opportunities and recommending particular shots based upon a user's skill level.

Processing proceeds through a series of steps to identify shot opportunities based upon the detected ball locations and user attributes (pre-defined process block 1420, see FIG. 15 and corresponding text for further details). At step 1430, processing displays the shot opportunities on the smart table. In one embodiment, processing may highlight a recommended shot opportunity, or a set of shot opportunities, such as that shown in FIG. 7. The recommended shot opportunity (or set of shot opportunities) is shots that a user has a higher probability of success based upon the user's skill level (shot type success rate).

A determination is made as to whether a user has enabled a stick guidance capability (decision 1440). The stick guidance capability monitors a user's smart stick location and informs the user through various means (e.g., stick vibration) as to when the smart stick is out of alignment or in alignment for a particular shot (see FIG. 8 and corresponding text for further details).

If the smart stick guidance is enabled, decision 1440 branches to "Yes" branch 1442 whereupon the game system sends a signal to the smart stick to vibrate until the game system detects that the smart stick is aligned properly for a particular shot (step 1450). On the other hand, if the smart stick guidance is not enabled, decision 1440 branches to "No" branch 1448 bypassing step 1450. Processing waits for the user to shoot at 1460. Once the user shoots, processing detects and stores the shot results at step 1470 (e.g., log whether the user pocketed the ball and the shot type (straight shot, bank shot, etc.)).

A determination is made as to whether to continue the game (decision 1480). If the game should continue, decision 1480 branches to "Yes" branch 1482, which loops back to detect the new ball locations and identify shot opportunities. This looping continues until processing should terminate the game, at which point decision 1480 branches to "No" branch 1488 whereupon processing returns at 1490.

FIG. 15 is a flowchart showing steps taken in identifying shot opportunities and recommending particular shots based upon a user's skill level. Processing commences at 1500, whereupon processing computes and stores one or more beginning shot opportunities in shot store 1422 based upon ball locations that were detected in FIG. 14 (step 1510). Shot store 1422 is the same as that shown in FIG. 14.

Processing selects the first beginning shot opportunity at step 1520 and, at step 1525, processing computes a shot success probability based upon the type of the shot opportunity and the user's corresponding shot type success rate. For example, the first beginning shot opportunity may be a straight shot and, in this example the user may have an 80% (or 8 rating) success rate for straight shots. Processing uses this value in determining the shot success probability of the first beginning shot opportunity.

At step 1528, processing analyzes potential ball and cue ball locations, which are those locations that processing estimates if the user were to take the selected shot opportunity. Based on the analysis, a determination is made as to whether there are subsequent shot opportunities (follow-up shot opportunities) after the first beginning shot opportunity (decision 1530). If there is a subsequent shot opportunity, decision 1530 branches to "Yes" branch 1532, which loops back to compute a shot success probability for the subsequent shot opportunity using the user's shot type success rate for the type of shot (step 1535). At step 1540, processing stores the subsequent shot opportunity in a "set of shot opportunities" with the selected beginning shot opportunity.

Processing then proceeds again to step 1528, whereupon processing analyzes potential ball and cue ball locations assuming that the user were to take the first subsequent shot opportunity. This looping continues until there are no more subsequent shot opportunities, at which point decision 1530 ranches to "No" branch 1538, whereupon a determination is made as to whether there are more beginning shot opportunities (decision 1550).

If there are more beginning shot opportunities, decision 1550 branches to "Yes" branch 1552, which loops back to select (step 1560) and process the next beginning shot opportunity. This looping continues until there are no more beginning shot opportunities to evaluate, at which point decision 1550 branches to "No" branch 1558. Processing evaluates the stored shot success probabilities for the beginning shots and subsequent shot opportunities, and identifies a recommended set of shot opportunities that has the highest cumulative shot success probability (step 1570). For example, one set of shot opportunities may include a number of bank shots and, in this example, the user is proficient at making bank shots. As such, this set of shot opportunities has a high cumulative shot success probability. Processing returns at 1580.

One of the preferred implementations of the invention is a client application, namely, a set of instructions (program code) or other functional descriptive material in a code module that may, for example, be resident in the random access memory of the computer. Until required by the computer, the set of instructions may be stored in another computer memory, for example, in a hard disk drive, or in a removable memory such as an optical disk (for eventual use in a CD ROM) or floppy disk (for eventual use in a floppy disk drive). Thus, the present invention may be implemented as a computer program product for use in a computer. In addition, although the various methods described are conveniently implemented in a general purpose computer selectively activated or reconfigured by software, one of ordinary skill in the art would also recognize that such methods may be carried out in hardware, in firmware, or in more specialized apparatus constructed to perform the required method steps. Functional descriptive material is information that imparts functionality to a machine. Functional descriptive material includes, but is not limited to, computer programs, instructions, rules, facts, definitions of computable functions, objects, and data structures.

While particular embodiments of the present invention have been shown and described, it will be obvious to those skilled in the art that, based upon the teachings herein, that changes and modifications may be made without departing from this invention and its broader aspects. Therefore, the appended claims are to encompass within their scope all such changes and modifications as are within the true spirit and scope of this invention. Furthermore, it is to be understood that the invention is solely defined by the appended claims. It will be understood by those with skill in the art that if a specific number of an introduced claim element is intended, such intent will be explicitly recited in the claim, and in the absence of such recitation no such limitation is present. For non-limiting example, as an aid to understanding, the following appended claims contain usage of the introductory phrases "at least one" and "one or more" to introduce claim elements. However, the use of such phrases should not be construed to imply that the introduction of a claim element by the indefinite articles "a" or "an" limits any particular claim containing such introduced claim element to inventions containing only one such element, even when the same claim includes the introductory phrases "one or more" or "at least one" and indefinite articles such as "a" or "an"; the same holds true for the use in the claims of definite articles.

What is claimed is:

1. An information handling system comprising:

one or more processors;

a memory accessible by at least one of the processors;

a nonvolatile storage area accessible by at least one of the processors;

a set of instructions stored in the memory and executed by at least one of the processors in order to perform actions of:

receiving a request from a user to play a cue sport that includes a table and a plurality of balls;

retrieving user attributes that correspond to the user;

detecting a plurality of ball locations corresponding to the plurality of balls on the table;

identifying, based upon one or more of the plurality of ball locations, a first beginning shot opportunity that includes a cue ball and a first ball;

identifying, based upon one or more of the plurality of ball locations, a second beginning shot opportunity that includes the cue ball and a second ball, wherein the second ball is different than the first ball;

determining that the first beginning shot opportunity corresponds to a higher probability of success than the second beginning shot opportunity based upon a user skill level and a user height included in the user attributes; and recommending to the user the first beginning shot opportunity over the second beginning shot opportunity in response to determining that the first beginning shot opportunity corresponds to a higher probability of success than the second beginning shot opportunity, wherein the recommending includes providing the first beginning shot opportunity and the second beginning shot opportunity to the user and highlighting the first beginning shot opportunity.

2. The information handling system of claim 1 wherein the information handling system further performs actions that include:

detecting a shot type of the first beginning shot opportunity based upon the plurality of ball locations;

computing a shot success probability for the first beginning shot opportunity based upon the shot type and a ball pocketing success rate for the user corresponding to the shot type; and utilizing the computed shot success probability during the determination that the first beginning shot opportunity has the higher probability of success based upon the user skill level.

3. The information handling system of claim 1 wherein the information handling system further performs actions that include:

identifying a first set of shot opportunities that includes the first beginning shot and one or more subsequent first set shot opportunities corresponding to a first set of balls from the plurality of balls;

identifying a second set of shot opportunities that includes the second beginning shot and one or more subsequent second set shot opportunities corresponding to a second set of balls from the plurality of balls;

determining that the first set of shot opportunities results in a higher net ball pocketing than the second set of shot opportunities; and recommending the first set of shot opportunities over the second set of shot opportunities in response to determining that the first set of shot opportunities results in the higher net ball pocketing than the second set of shot opportunities.

4. The information handling system of claim 1 wherein the information handling system further performs actions that include:

computing a historical shot accuracy by tracking a ball pocketing success rate for one or more shot types; and adjusting the user skill level included in the user attributes based upon the historical shot accuracy.

5. A computer-implemented method comprising:

receiving a request from a user to play a cue sport that includes a table and a plurality of balls;

retrieving, by a processing device, user attributes that correspond to the user;

detecting, by the processing device, a plurality of ball locations corresponding to the plurality of balls on the table;

identifying, by the processing device based upon one or more of the plurality of ball locations, a first beginning shot opportunity that includes a cue ball and a first ball;

identifying, by the processing device based upon one or more of the plurality of ball locations, a second beginning shot opportunity that includes the cue ball and a second ball, wherein the second ball is different than the first ball;

determining, by the processing device, that the first beginning shot opportunity corresponds to a higher probability of success than the second beginning shot opportunity based upon a user skill level and a user height included in the user attributes; and recommending to the user, by the processing device, the first beginning shot opportunity over the second beginning shot opportunity in response to determining that the first beginning shot opportunity corresponds to a higher probability of success than the second beginning shot opportunity, wherein the recommending includes providing the first beginning shot opportunity and the second beginning shot opportunity to the user and highlighting the first beginning shot opportunity.

6. The method of claim 5 further comprising:

detecting a shot type of the first beginning shot opportunity based upon the plurality of ball locations;

computing a shot success probability for the first beginning shot opportunity based upon the shot type and a ball pocketing success rate for the user corresponding to the shot type; and utilizing the computed shot success probability during the determination that the first beginning shot opportunity has the higher probability of success based upon the user skill level.

7. The method of claim 5 further comprising:

identifying a first set of shot opportunities that includes the first beginning shot and one or more subsequent first set shot opportunities corresponding to a first set of balls from the plurality of balls;

identifying a second set of shot opportunities that includes the second beginning shot and one or more subsequent second set shot opportunities corresponding to a second set of balls from the plurality of balls;

determining that the first set of shot opportunities results in a higher net ball pocketing than the second set of shot opportunities; and recommending the first set of shot opportunities over the second set of shot opportunities in response to determining that the first set of shot opportunities results in the higher net ball pocketing than the second set of shot opportunities.

8. The method of claim 5 further comprising:

computing a historical shot accuracy by tracking a ball pocketing success rate for one or more shot types; and adjusting the user skill level included in the user attributes based upon the historical shot accuracy.

9. The method of claim 5 wherein equipment attributes are utilized during the determination of the one or more beginning shot opportunities, wherein at least one of the equipment attributes is selected from the group consisting of stick attributes and table attributes.

10. The method of claim 5 wherein environmental attributes are utilized during the determination of the one or more beginning shot opportunities, wherein at least one of the environmental attributes is emotional status.

11. A computer program product stored in a computer readable medium, comprising functional descriptive material that, when executed by an information handling system, causes the information handling system to perform actions that include:

receiving a request from a user to play a cue sport that includes a table and a plurality of balls;

retrieving user attributes that correspond to the user;

detecting a plurality of ball locations corresponding to the plurality of balls on the table;

identifying, based upon one or more of the plurality of ball locations, a first beginning shot opportunity that includes a cue ball and a first ball;

identifying, based upon one or more of the plurality of ball locations, a second beginning shot opportunity that includes the cue ball and a second ball, wherein the second ball is different than the first ball;

determining that the first beginning shot opportunity corresponds to a higher probability of success than the second beginning shot opportunity based upon a user skill level and a user height included in the user attributes; and recommending to the user the first beginning shot opportunity over the second beginning shot opportunity in response to determining that the first beginning shot opportunity corresponds to a higher probability of success than the second beginning shot opportunity, wherein the recommending includes providing the first beginning shot opportunity and the second beginning shot opportunity to the user and highlighting the first beginning shot opportunity.

12. The computer program product of claim 11 wherein the information handling system further performs actions that include:

detecting a shot type of the first beginning shot opportunity based upon the plurality of ball locations;

computing a shot success probability for the first beginning shot opportunity based upon the shot type and a ball pocketing success rate for the user corresponding to the shot type; and utilizing the computed shot success probability during the determination that the first beginning shot opportunity has the higher probability of success based upon the user skill level.

13. The computer program product of claim 11 wherein the information handling system further performs actions that include:

identifying a first set of shot opportunities that includes the first beginning shot and one or more subsequent first set shot opportunities corresponding to a first set of balls from the plurality of balls;

identifying a second set of shot opportunities that includes the second beginning shot and one or more subsequent second set shot opportunities corresponding to a second set of balls from the plurality of balls;

determining that the first set of shot opportunities results in a higher net ball pocketing than the second set of shot opportunities; and recommending the first set of shot opportunities over the second set of shot opportunities in response to determining that the first set of shot opportunities results in the higher net ball pocketing than the second set of shot opportunities.

14. The computer program product of claim 11 wherein the information handling system further performs actions that include:

computing a historical shot accuracy by tracking a ball pocketing success rate for one or more shot types; and adjusting the user skill level included in the user attributes based upon the historical shot accuracy.

* * * * *